US010590756B2

(12) United States Patent
Mosser

(10) Patent No.: US 10,590,756 B2
(45) Date of Patent: Mar. 17, 2020

(54) DRILLING RIG INCLUDING A DEVICE FOR CONNECTING A DEVICE FOR MEASURING VERTICALITY

(71) Applicant: SOLETANCHE FREYSSINET, Rueil Malmaison (FR)

(72) Inventor: Jean-François Mosser, Rueil Malmaison (FR)

(73) Assignee: Soletanche Freyssinet, Rueil Malmaison (FR)

( * ) Notice: Subject to any disclaimer, the term of this patent is extended or adjusted under 35 U.S.C. 154(b) by 0 days.

(21) Appl. No.: 16/295,057

(22) Filed: Mar. 7, 2019

(65) Prior Publication Data

US 2019/0277132 A1 Sep. 12, 2019

(30) Foreign Application Priority Data

Mar. 9, 2018 (FR) ..... 18 52064

(51) Int. Cl.

| | |
|---|---|
| ***E21B 23/14*** | (2006.01) |
| ***E21B 3/02*** | (2006.01) |
| ***E21B 7/02*** | (2006.01) |
| ***E21B 47/022*** | (2012.01) |

(52) U.S. Cl.
CPC ..... *E21B 47/022* (2013.01)

(58) Field of Classification Search
CPC ..... E21B 23/14; E21B 3/02; E21B 47/024; E21B 7/02; E21B 7/06; E21B 7/022; E21B 34/102; E21B 17/18
See application file for complete search history.

(56) References Cited

U.S. PATENT DOCUMENTS 1,738,589 A * 12/1929 Koppl ..... E21B 47/02232 33/308
1,988,741 A * 1/1935 Lynch ..... E21B 47/02232 33/306
2,166,212 A * 7/1939 Hayward ..... E21B 47/04 33/736
2,205,729 A * 6/1940 Monroe ..... E21B 47/02232 33/402
2,303,360 A * 12/1942 Irwin ..... E21B 47/022 33/312
2,326,219 A * 8/1943 Hayward ..... E21B 47/04 33/737

(Continued)

FOREIGN PATENT DOCUMENTS

| | | |
|---|---|---|
| EP | 0841465 A1 | 5/1998 |
| FR | 2211027 A5 | 7/1974 |
| JP | H06108456 A | 4/1994 |

*Primary Examiner* — Benjamin F Fiorello
*Assistant Examiner* — Edwin J Toledo-Duran
(74) *Attorney, Agent, or Firm* — Yasser Mourtada

(57) ABSTRACT

The disclosure relates to a drilling rig for cutting a vertical trench in the ground, the rig comprising:

a frame; and a verticality measurement device comprising a first cable and at least a first inclinometer, one end of the first cable being connected to the top portion of the frame and to the first inclinometer.

According to the disclosure, the drilling rig has a first connection device comprising:

a support fastened to the frame; and a body connected to the support via a swivel link;

the first inclinometer and the first cable are fastened to the body on opposite sides of the swivel link.

12 Claims, 4 Drawing Sheets

(56) References Cited

U.S. PATENT DOCUMENTS 2,380,520 A * 7/1945 Hassler ..... E21B 47/18 367/83
2,590,880 A * 4/1952 Miller ..... E21B 47/024 33/285
2,676,787 A * 4/1954 Johnson ..... E21B 7/12 175/7
2,710,169 A * 6/1955 Prescott ..... E21B 47/026 175/44
2,719,024 A * 9/1955 Prescott ..... E21B 47/026 166/104
2,723,374 A * 11/1955 Williams ..... G01V 3/24 324/366
2,887,298 A * 5/1959 Hampton ..... E21B 47/185 33/307
2,925,251 A * 2/1960 Arps ..... E21B 47/12 175/39
2,933,820 A * 4/1960 Bobo ..... E21B 47/02232 33/306
3,225,826 A * 12/1965 Postlewaite ..... E21B 43/013 166/352
3,288,210 A * 11/1966 Bryant ..... E21B 47/024 166/254.1
3,359,782 A * 12/1967 Bey ..... G01C 9/12 33/308
3,448,612 A * 6/1969 Lebourg ..... E21B 47/022 73/152.54
3,534,477 A * 10/1970 Nahas ..... E02B 3/122 33/1 R
3,637,032 A * 1/1972 Jeter ..... E21B 7/06 175/73
4,836,305 A * 6/1989 Curlett ..... E21B 21/08 175/215
4,854,397 A * 8/1989 Warren ..... E21B 4/20 175/26
5,018,590 A * 5/1991 Weldon ..... E21B 4/12 175/105
5,215,151 A * 6/1993 Smith ..... E21B 4/02 166/237
5,235,285 A * 8/1993 Clark ..... E21B 17/1078 324/342
5,488,989 A * 2/1996 Leising ..... E21B 7/061 166/255.3
5,947,213 A * 9/1999 Angle ..... E21B 4/18 166/250.01
6,112,809 A * 9/2000 Angle ..... E21B 4/18 166/50
9,617,712 B2 4/2017 Soletanche
10,385,677 B2 * 8/2019 Gzara ..... E21B 43/00
10,465,505 B2 * 11/2019 Disko ..... E21B 47/12
10,466,719 B2 * 11/2019 Kibler ..... E21B 43/26
2001/0024597 A1 * 9/2001 Turner ..... E21B 7/20 405/184
2002/0074125 A1 * 6/2002 Fikes ..... E21B 15/003 166/352
2003/0222651 A1 * 12/2003 Tabanou ..... G01V 3/20 324/367
2004/0256153 A1 * 12/2004 Helms ..... E21B 7/062 175/45
2007/0119630 A1 * 5/2007 Hall ..... E21B 4/02 175/73
2008/0024319 A1 * 1/2008 Close ..... E21B 47/18 340/854.3
2009/0152005 A1 * 6/2009 Chapman ..... E21B 7/00 175/24
2010/0110833 A1 * 5/2010 Close ..... E21B 47/18 367/83
2010/0307742 A1 * 12/2010 Phillips ..... E21B 47/022 166/250.01
2011/0156357 A1 * 6/2011 Noguchi ..... C09K 3/1009 277/336
2013/0223939 A1 * 8/2013 Schwanz ..... E02D 5/18 405/267
2014/0102794 A1 * 4/2014 Tevis ..... E21B 49/06 175/44
2015/0275583 A1 * 10/2015 Angelici ..... E21B 7/06 175/45
2015/0275657 A1 * 10/2015 Deffenbaugh ..... E21B 47/14 340/854.4
2015/0300098 A1 * 10/2015 Logan ..... E21B 47/01 166/237
2016/0138381 A1 * 5/2016 Logan ..... E21B 4/006 175/24
2016/0312587 A1 * 10/2016 Montaron ..... E21B 29/06
2018/0283156 A1 * 10/2018 Viens ..... E21B 47/024
2019/0017326 A1 * 1/2019 Orban ..... E21B 3/02
2019/0078428 A1 * 3/2019 Fang ..... E21B 44/04

* cited by examiner

DRILLING RIG INCLUDING A DEVICE FOR CONNECTING A DEVICE FOR MEASURING VERTICALITY

BACKGROUND

The present disclosure relates to the field of measuring the verticality of the movement of a drilling rig.

Measuring the verticality of a drilling rig conventionally consists in continuously or periodically measuring any departures from the vertical of a drilling rig that is intended in particular to cut trenches of great depth and small width, typically equal to the width of the drilling rig.

Such rigs are particularly, but not exclusively, rotary drum drilling rigs. They are described in particular in Document FR 2 211 027. The drilling rig is suspended from a hoist by means of cables. The rig continues to move downwards progressively as the rotary drums cut the trench.

For certain kinds of work, the trench may present great depth, which may be as much as one hundred meters or more. It is generally necessary for the trench to present great accuracy concerning its verticality, in particular because the final trench is usually the result of juxtaposing vertical boreholes. The accuracy that is required may be of millimeter order in the horizontal direction for each meter of depth of the trench.

In particular because of irregularities of the terrain in which the trench is to be made, there exist major risks of the drilling rig deviating from its vertical path, with this risk increasing as the depth of the borehole increases.

There therefore exists a real need to have systems that make it possible to monitor the verticality of the movements of the machine, by detecting any departures from the desired vertical path.

To solve this problem, Document EP 0 841 465 proposes a device for continuously measuring the verticality of a drilling rig, which device also makes it possible to detect twisting movements or crabwise movements of the rig.

The drilling rig described in that document thus includes a device for measuring the verticality of the movement of a drilling rig for cutting a vertical trench from the surface of the ground, said rig comprising a top end secured to means for supporting the rig while it is being lowered, a bottom end, and a vertical longitudinal axis, the device further comprising:

- two small-section cables, each cable having a first end fastened to the top end of the rig, the two fastening points being different;
- means for keeping said cables tensioned;
- two guide means arranged above the surface of the ground to ensure, at least at the measurement instants, that the portion of each cable that is arranged in a horizontal plane is kept stationary in said plane while the rig is being lowered, said guide means defining two fixed reference points in a spatial relationship with said fastener points when they are in said horizontal plane;
- means for measuring in two mutually orthogonal horizontal directions the angles of inclination of the portion of each cable extending between said fastener points and said guide means;
- means for measuring the lengths of the portions of cable extending between the fastener points and the guide means while the rig is being lowered;
- means secured to the rig to measure the angles of inclination of the longitudinal axis of said rig in two mutually orthogonal horizontal directions; and

- processor means for using said measured lengths and said measured angles of inclination to calculate the movements of the two cable fastener points in said orthogonal directions and for using the calculated movements of the fastener points of the two cables and the two measured angles of inclination of the vertical axis of the rig to calculate the movements of two different fixed points of the bottom end of said rig.

It can be understood that by continuously measuring the length of the cables between the top end of the rig and the fixed guide means, and by measuring angles of inclination at the ends of the cables fastened to the rig, it is possible to calculate continuously the coordinates of the two fastener points of the cables and thus to calculate any departures in position of the cables from the reference positions defined using the two fixed guide means. In that document, provision is made for an inclinometer to be arranged between one end of the cable and a swivel system fastened to the rig.

SUMMARY

An object of the disclosure is to provide a drilling rig that remedies the above-mentioned drawbacks.

To do this, the disclosure provides a drilling rig for cutting a vertical trench from the surface of the ground, the rig comprising:

- a frame having a top portion secured to a carrying device for carrying the frame; and
- a verticality measurement device comprising at least a first cable and at least a first inclinometer, one end of the first cable being connected to the top portion of the frame and to the first inclinometer.

In characteristic manner, the drilling rig further comprises at least one first connection device comprising:

- a support fastened to the frame; and
- a body connected to the support via a swivel link;

the first inclinometer and the first cable being fastened to the body while being arranged on opposite sides of the swivel link.

By means of the embodiments of the disclosure, the tensioned first cable exerts traction on the frame via the swivel link and no longer via the inclinometer as in the prior art. This direct link between the first cable and the frame enhances applying tension and keeping tensioned, thereby having the effect of improving the accuracy of the measurements.

It can also be understood that the inclinometer is arranged beneath the swivel link, such that the tension acting on the first cable is taken up by the swivel link and no longer by the inclinometer as in the prior art, thereby improving the robustness of the measurement device.

Advantageously, the frame also includes a bottom portion that is provided with an excavator device.

Advantageously, the body includes a fastener member for holding the end of the first cable. An advantage of the fastener member is to facilitate connecting and disconnecting the first cable to and from the first connection device, thereby facilitating maintenance operations, e.g. in the event of the first cable breaking.

Advantageously, the body is provided with a duct into which the first cable is inserted. The duct serves to guide insertion of the first cable into the body, thereby making it easier to connect. Preferably, the duct is inside a tube that co-operates with the fastener member.

Advantageously, the support includes a fastener portion for fastening the support to the frame, and said fastener portion is arranged between the end of the first cable and the swivel link.

An advantage is to be able to place the swivel link and the first inclinometer inside the frame, thereby contributing to reducing their exposure to pieces of excavated ground that are to be found in the trench.

Specifically, it can be understood that the first inclinometer and the swivel link are arranged under the fastener fastening, thereby enabling the first inclinometer and the swivel link to be housed inside the volume of the frame.

In other words, this advantageous configuration serves to protect the swivel link and the first inclinometer by reducing their exposure to pieces of excavated ground that are to be found in the trench.

Preferably, the fastener portion includes a plate having a central opening, and the body extends through the central opening.

Advantageously, the body includes a first end carrying the first inclinometer and a second end remote from the first end, the support including a guide portion surrounding the second end of the body.

An advantage of this guide portion is to limit movement of the body inside the guide portion. The guide portion also has the function of protecting the body, e.g. against falling stones.

Preferably, the guide portion includes an annular element with an axis passing through the swivel link.

The annular element forms an annular abutment that serves to limit the angle through which the body can pivot relative to the frame. The annular element also contributes to protecting the second end of the body.

Preferably, the second end of the body has a disk into which the above-mentioned duct leads. The disk presents a diameter greater than that of the tube and serves to further limit movement of the body.

Advantageously, the frame presents a longitudinal direction, and the axis of the guide portion is parallel to the longitudinal direction of the frame.

Advantageously, the first connection device includes at least one housing in which the swivel link is arranged, and at least one sealing bellows arranged between the housing and the body.

It can be understood that the tube of the body and the first inclinometer are arranged on opposite sides of the housing. In addition, the sealing bellows has the function of protecting the element constituting the swivel link, in particular when drilling is performed in mud.

Advantageously, the center of gravity of the assembly constituted by the first connection device and the first inclinometer is situated in the swivel link.

Preferably, said drilling rig is a cutter having cutter drums that rotate about axes perpendicular to the longitudinal axis of the frame.

Although some features, concepts or aspects of the embodiments may be described herein as being a preferred (more or less) arrangement or method, or an advantageous arrangement or method, such description is not intended to suggest that such feature or features are required or necessary unless expressly so stated.

BRIEF DESCRIPTION OF THE DRAWINGS

The disclosure can be better understood on reading the following description of an embodiment of the disclosure given by way of non-limiting example, and with reference to the accompanying drawings, in which.

Figure 1:
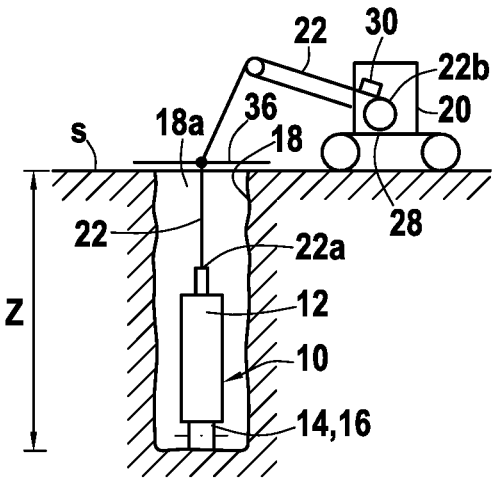
FIG.1 PRIOR ART
FIGS. 1 and 2 show a prior art drilling rig.

While embodiments of the disclosure are amenable to various modifications and alternative forms, specifics thereof have been shown by way of example in the drawings and will be described in detail. It should be understood, however, that the intention is not to limit embodiments of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative embodiments and are not intended to limit the scope of the disclosure. The illustrative embodiments depicted are intended only as exemplary.

Figure 2:
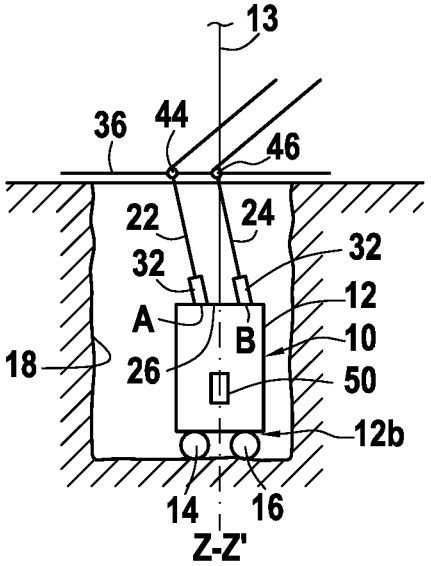
FIG.2 PRIOR ART
Figure 3:
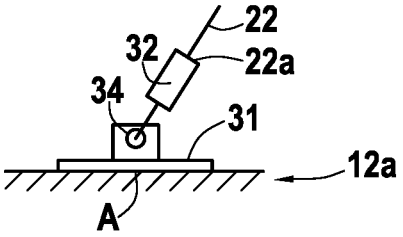
FIG.3 PRIOR ART
FIG. 3 shows a prior art connection device.

With reference to FIGS. 1 to 3, there follows a description of a prior art device for measuring verticality and that is mounted on a drilling rig.

These figures show a drilling rig 10, e.g. of the rotary drum cutter type. The rig essentially comprises a frame 12 and two rotary drums 14 and 16. The rig is shown in a trench 18, which it is in the process of cutting.

The rig 10 is suspended from a hoist 20 by a block and tackle, not shown.

In embodiments of the disclosure, first and second cables 22 and 24 have their first ends 22*a* and 24*a* fastened respectively at two different points A and B at the top end 26 of the frame 12 of the drilling rig. The cables 22 and 24 are of small section so as to present little stiffness. This does not present any drawback since they do not support the drilling rig.

Preferably, but not necessarily, the points A and B are arranged in the midplane of the frame of the drilling rig in its width direction, i.e. in the direction of its long dimension in horizontal section.

The other end 22*b*, 24*b* of each cable 22, 24 is mounted on a drum 28 carried by the hoist 20. The drum is fitted with a system serving to keep the cables 22 and 24 tensioned while the drilling rig is being lowered.

Furthermore, provision is made for each cable to have a device 30 for measuring the length of cable that has been wound out while the drilling rig is being lowered. It is thus possible continuously to know the depth Z of the drums 14 and 16 of the drilling rig relative to the surface of the ground S in which the trench 18 is being excavated.

For further explanation about the operation of said device, reference may be made to Document EP 0 841 465.

FIG. 3 shows in greater detail how the end 22*a* of the cable 22 is fastened to the top end 26 of the frame 12 of the drilling rig in the prior art. The fastener device has a bottom plate 31 secured to the top end 26 and fastened to the point A.

The plate 31 is connected to an inclinometer 32 by means of a swivel system 34. The inclinometer is secured to the end 22*a* of the first cable 22. The information provided by the inclinometer 32 corresponds to the angles of inclination of the terminal portion of the first cable 22, and that information is not disturbed by any twisting of the cable or by any stiffness of the cable in its fastening zone.

The present disclosure provides an alternative to the prior art connection device shown in FIG. 3.

Figure 4:
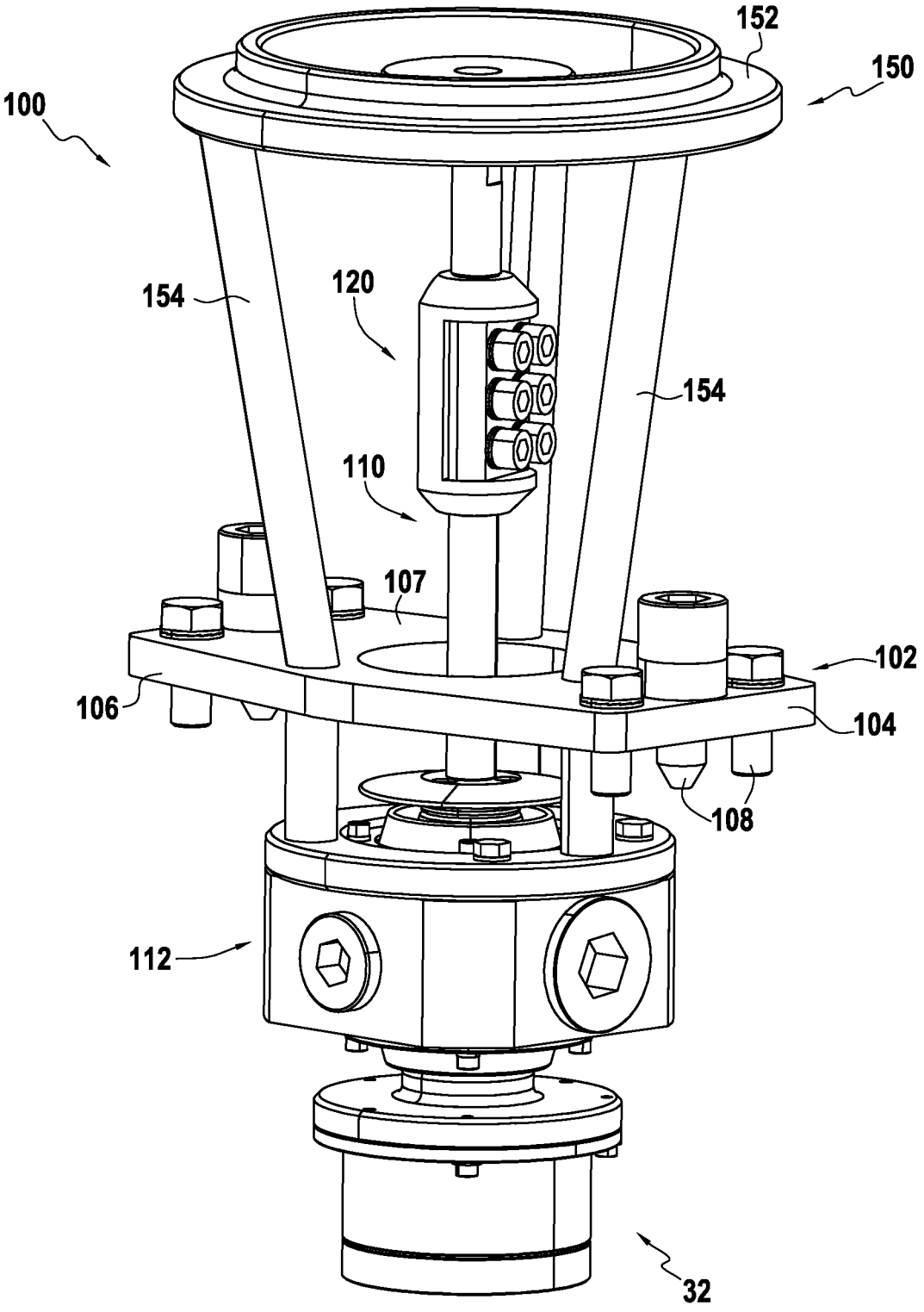
FIG. 4 is a perspective view of a connection device in accordance with embodiments of the disclosure.

FIG. 4 shows an embodiment of a first connection device 100 in accordance with the present disclosure.

This first connection device 100 comprises a support 102 that is configured to be fastened to the top portion 12*a* of the frame 12. For this purpose, the support 102 has a fastener portion 104 for fastening the support to the frame, by means of bolts 108.

Figure 5:
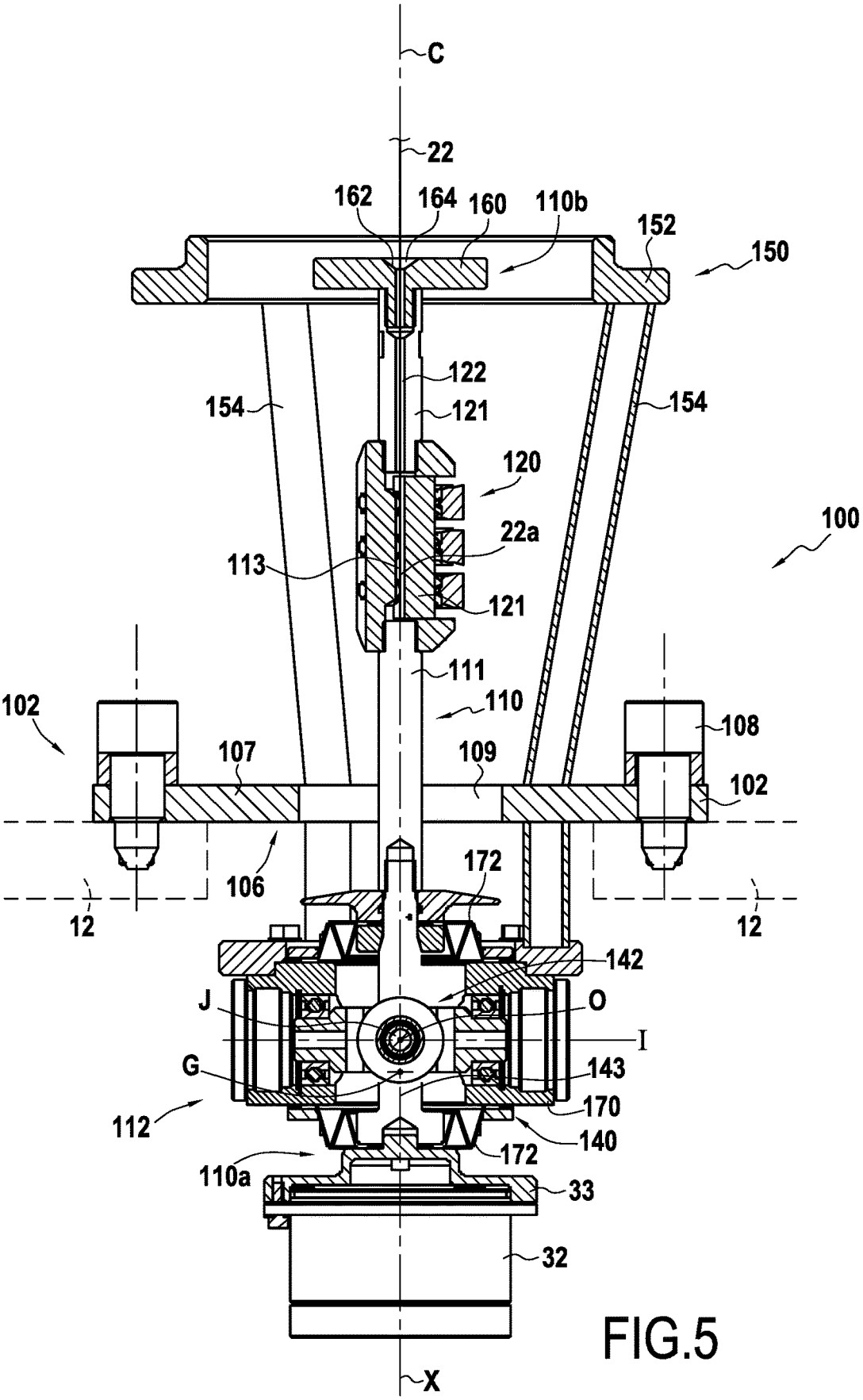
FIG. 5 is an axial section view of the FIG. 4 device.

The first connection device 100 also has a body 110 that is connected to the support 102 via a swivel link 112, that can be seen better in the section view of FIG. 5.

The body 110 has a fastener member 120 for holding the end 22*a* of the first cable 22. As can be seen from FIG. 5, the body 110 has a tube 121 that is provided with a duct 122 of diameter that is slightly greater than the diameter of the first cable. The first cable 22 is inserted in the duct 122 so that the end 22*a*, or at least an end portion, of the cable, is engaged with the fastener member 120.

In this example, the fastener member 120 comprises a plurality of screws 121 for securing the end 22*a* of the first cable 22 to the body 110.

The fastener member also has a passage 123 arranged in continuity with the duct 122 in which the end 22*a* of the first cable 22 is inserted.

With reference to FIG. 5, it can be seen that the fastener portion 106 has a plate 107 with a central opening 109, the body 110 extending through said central opening 109. This central opening 109 presents a cross-section that is substantially circular.

The first connection device 100 also has a first inclinometer 32 that is fastened to the body 110.

More precisely, in accordance with the disclosure, the first inclinometer 32 and the end 22*a* of the first cable 22 are fastened to the body 110 on opposite sides of the swivel link 112.

In this example, the swivel link 112 has a center O and it is constituted by a first pivot link 140 having a pivot axis I extending transversely to the longitudinal direction X of the duct 122. This first pivot link 140, visible in FIG. 5, is associated with a second pivot link 142 that presents a second pivot axis J perpendicular to the first pivot axis I and likewise perpendicular to the longitudinal direction X of the duct 122. The pivot axes I and J intersect at the center O of the swivel link.

By means of the swivel link 112, the assembly constituted by the body 110 and the first inclinometer 32 can swivel relative to the support 102.

Furthermore, the body 110 has a first end 110*a* carrying the first inclinometer 32. In this example, the first inclinometer 32 is fastened to a support 33. The support 33 is itself connected to movable element 143 of the swivel link 140, this movable element 143 itself being fastened to a rod 111 of the body 110. This rod 111 is secured to the fastener member 120, which is itself secured to the tube 121.

The body 110 also has a second end 110*b* remote from the first end 110*a*. This second end 110*b* is situated at the end of the tube 121 remote from the fastener member 120. The support 102 also has a guide portion 150 that surrounds the second end 110*b* of the body 110. This guide portion 150 includes an annular element 152 with an axis C passing through the center O of the swivel link.

This annular element 152 is connected to the plate 107 by junction elements 154.

Figure 6:
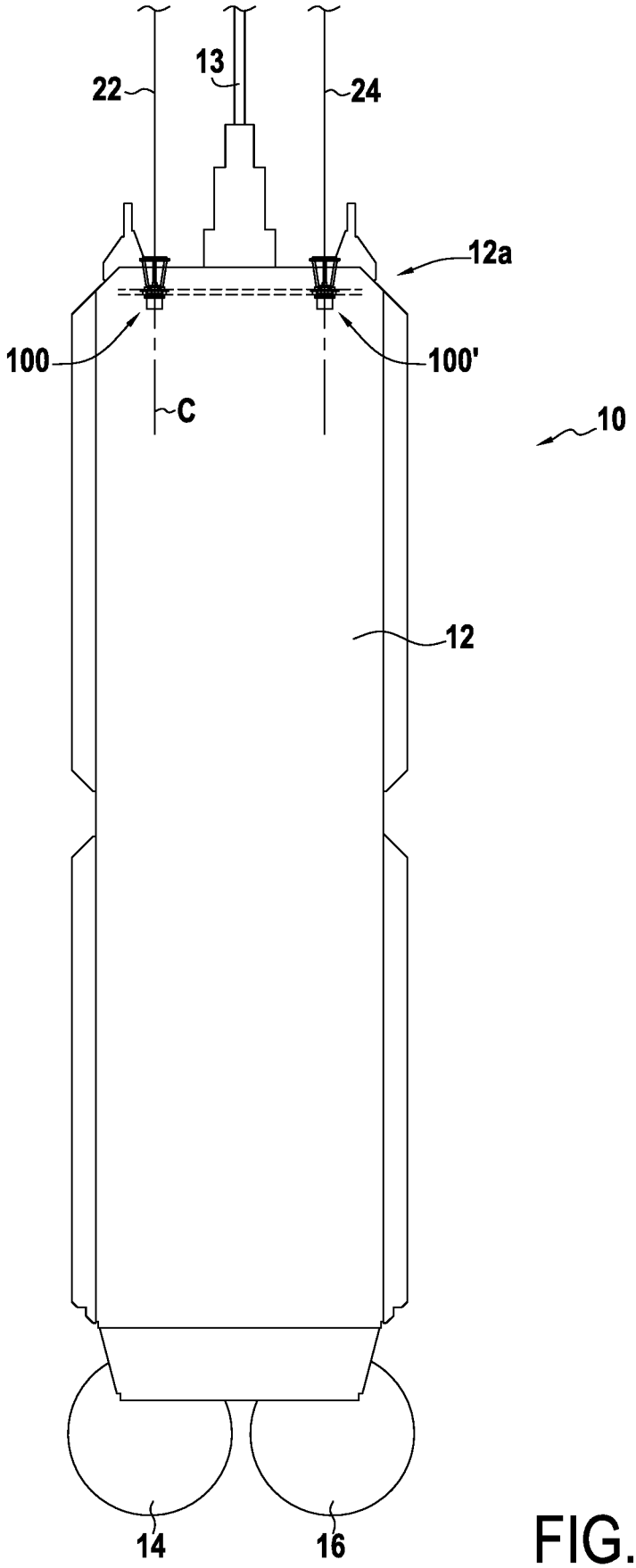
FIG. 6 shows a drilling rig of the disclosure including a pair of FIG. 4 connection devices.

The frame also presents a longitudinal direction L, and the axis C of the annular element 152 is parallel to the longitudinal direction L of the frame, as shown in FIG. 6.

With reference once more to FIG. 5, it can be seen that the body 110 has a disk 160 that is installed at the end of the tube 121, the disk 160 including a channel 162 in communication with the duct 122, and an outlet orifice 164 of frustoconical shape leading to the outside.

It can also be understood that the annular element 152 serves to limit angular movement about the center O of the swivel link, and in this example the angular movement as seen from the vertex O of a cone lies in the range 5° to 9°, and is preferably about 7° or 8°.

With reference once more to FIG. 5, it can be seen that the first connection device 100 has a housing 170 containing the swivel link 112, and a sealing bellows 172 that is arranged between the housing and the body 110 in order to protect the elements constituting the swivel link 112.

In this element, the center of gravity G of the assembly constituted by the first connection device 100 and the first inclinometer 32 is situated at the swivel link 112, in the proximity of the center O of said swivel link. By means of this provision, the connection device does not impede movement of the cable 22, thus making it possible to obtain verticality measurements that are very accurate.

With reference to FIG. 6, it can be seen that the frame is provided with the first connection device 100 as described above and with a second connection device 100', identical to the first connection device 100. As explained above, the plates of the first and second connection devices 100 and 100' are fastened to the frame 12.

Although the described embodiments were provided as different exemplary embodiments, it is envisioned that these embodiments are combinable or, when not conflicting, the features recited in the described embodiments may be interchangeable.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A drilling rig for cutting a vertical trench from a surface of a ground, the rig comprising:

a frame having a top portion secured to a carrying device for carrying the frame; and a verticality measurement device comprising at least a first cable and at least a first inclinometer, one end of the first cable being connected to the top portion of the frame and to the first inclinometer;

wherein the drilling rig further comprises at least one first connection device comprising:

a support fastened to the frame; and a body connected to the support via a swivel link;

and wherein the first inclinometer and the first cable are fastened to the body while being arranged on opposite sides of the swivel link.

2. The drilling rig according to claim 1, wherein the body includes a fastener member for holding the end of the first cable.

3. The drilling rig according to claim 1, wherein the body is provided with a duct into which the first cable is inserted.

4. The drilling rig according to claim 1, wherein the support includes a fastener portion for fastening the support to the frame, and wherein said fastener portion is arranged between the end of the first cable and the swivel link.

5. The drilling rig according to claim 4, wherein the fastener portion includes a plate having a central opening, and wherein the body extends through the central opening.

6. The drilling rig according to claim 1, wherein the body includes a first end carrying the first inclinometer and a second end remote from the first end, and wherein the support includes a guide portion surrounding the second end of the body.

7. The drilling rig according to claim 6, wherein the guide portion includes an annular element with an axis passing through the swivel link.

8. The drilling rig according to claim 7, wherein the frame presents a longitudinal direction, and wherein the axis of the annular element is parallel to the longitudinal direction of the frame.

9. The drilling rig according to claim 1, wherein the first connection device includes at least one housing in which the swivel link is arranged, and at least one sealing bellows arranged between the housing and the body.

10. The drilling rig according to claim 1, wherein a center of gravity of an assembly constituted by the body and the first inclinometer is situated in the swivel link.

11. The drilling rig according to claim 1, wherein the frame also includes a bottom portion provided with an excavator device.

12. A cutter comprising a drilling rig according to claim 1.

* * * * *